US005486123A

United States Patent [19]

Miyazaki

[11] Patent Number: 5,486,123

[45] Date of Patent: Jan. 23, 1996

[54] CONNECTOR TERMINAL

[75] Inventor: Sho Miyazaki, Yokkaichi, Japan

[73] Assignee: Sumitomo Wiring Systems, Ltd., Mie, Japan

[21] Appl. No.: 207,675

[22] Filed: Mar. 9, 1994

[30] Foreign Application Priority Data

Mar. 18, 1993 [JP] Japan ..... 5-085784

[51] Int. Cl.[6] ..... H01R 13/05

[52] U.S. Cl. ..... 439/825; 439/826; 439/843

[58] Field of Search ..... 439/826, 825, 439/824, 851–857, 861, 862, 842, 843

[56] References Cited

U.S. PATENT DOCUMENTS 2,277,212 3/1942 Cunningham ..... 439/826
3,086,190 4/1963 Neidecker et al. ..... 439/826
3,716,817 2/1973 Wolfe, Jr. et al. ..... 439/826

FOREIGN PATENT DOCUMENTS 895490 1/1945 France .
923142 3/1955 Germany .
496593 12/1938 United Kingdom .

*Primary Examiner*—David L. Pirlot
*Attorney, Agent, or Firm*—Oliff & Berridge

[57] ABSTRACT

A connector terminal includes a first terminal having a cylindrical tubular portion, and a second terminal that can be connected to the cylindrical tubular portion. An outer terminal member and an inner terminal member for contacting respectively with outer and inner surfaces of the tubular portion are selectively attached to the second terminal. By selecting the two terminal members suitably, designs for respectively accommodating different allowable current values can be easily achieved.

10 Claims, 3 Drawing Sheets

CONNECTOR TERMINAL

BACKGROUND OF THE INVENTION

This invention relates to a connector terminal, and more particularly to a connector terminal that can selectively accommodate a small or relatively large current.

In the near future, it is expected that electric cars will be put into practical use. In such a case, it is essential to charge the battery, and a connector for charging purposes is an important element to be studied. For example, female and male terminals used for a connector have a large area of contact between them, since a charging current is relatively large, and it is necessary that a condition of positive contact between them should be achieved. Referring to one example of known terminals for a large-current connector, a male terminal is slightly larger in diameter than a female terminal, and expanding slots are formed in the male terminal. With this construction, the male terminal, while deformed radially inwardly, can be inserted into the female terminal, so that the two terminals are connected together with a predetermined contact pressure.

It is expected that a battery to be mounted on a large-size electric passenger car will be different in capacity from a battery to be mounted on a small-size electric passenger car. In this regard, the intensity of a charging current will differ depending on the kind of car. Specifically, a large-size passenger car may require 90A, while a small-size passenger car may require 60A. Therefore, the specification of the connector terminals must be changed in accordance with the allowable current value. For example, in order to increase the area of contact between the terminals with the increase of the allowable current value, the terminals of a larger diameter must be selected.

Therefore, a plurality of kinds of connector terminals for connection to the car, as well as a plurality of kinds of terminals for connection to a charger, are prepared in accordance with the allowable value of the charging current, and such specially-designed terminals are used in combination. If the number of combinations is thus increased, the manufacturing cost naturally increases, and management becomes complicated.

SUMMARY OF THE INVENTION

The present invention has been made in view of the foregoing, and an object of the invention is to provide a connector terminal that can be produced at lower costs, and wherein the management of the terminals can be simplified.

This and other objects of the present invention have been achieved by providing a connector terminal including a first terminal having a cylindrical tubular portion, and a second terminal that can be fitted in the tubular portion, wherein an outer terminal member and an inner terminal member for contacting respectively with outer and inner surfaces of the tubular portion are selectively attached to the second terminal in coaxial relation.

When two connectors are connected together, with the inner terminal member attached to the second terminal, the inner peripheral surface of the tubular portion of the first terminal is contacted with the outer peripheral surface of the inner terminal member. When the two connectors are connected together, with the outer terminal member further attached to the second terminal, the inner peripheral surface of the tubular portion of the first terminal is contacted with the inner terminal member while the outer peripheral surface of the tubular portion is contacted with the outer terminal member. Thus, by determining whether the terminal member is attached or not, the area of contact between the two terminals can be changed.

BRIEF DESCRIPTION OF THE DRAWINGS

These and other aspects and advantages of the present invention will become apparent from the following detailed description of preferred embodiments when taken in conjunction with the accompanying drawings, in which.

DETAILED DESCRIPTION OF PREFERRED EMBODIMENTS

An embodiment of the present invention will now be described in detail with reference to the drawings. FIGS. 1 to 4 show a first embodiment of the present invention in which the invention is applied to a terminal used for a charging connector of an electric car. The charging connector includes charging connectors to be connected to the car and a charger, respectively. Each of the above figures shows a set of terminals that are incorporated respectively into housings of the two connectors and can be fitted together.

Figure 1:
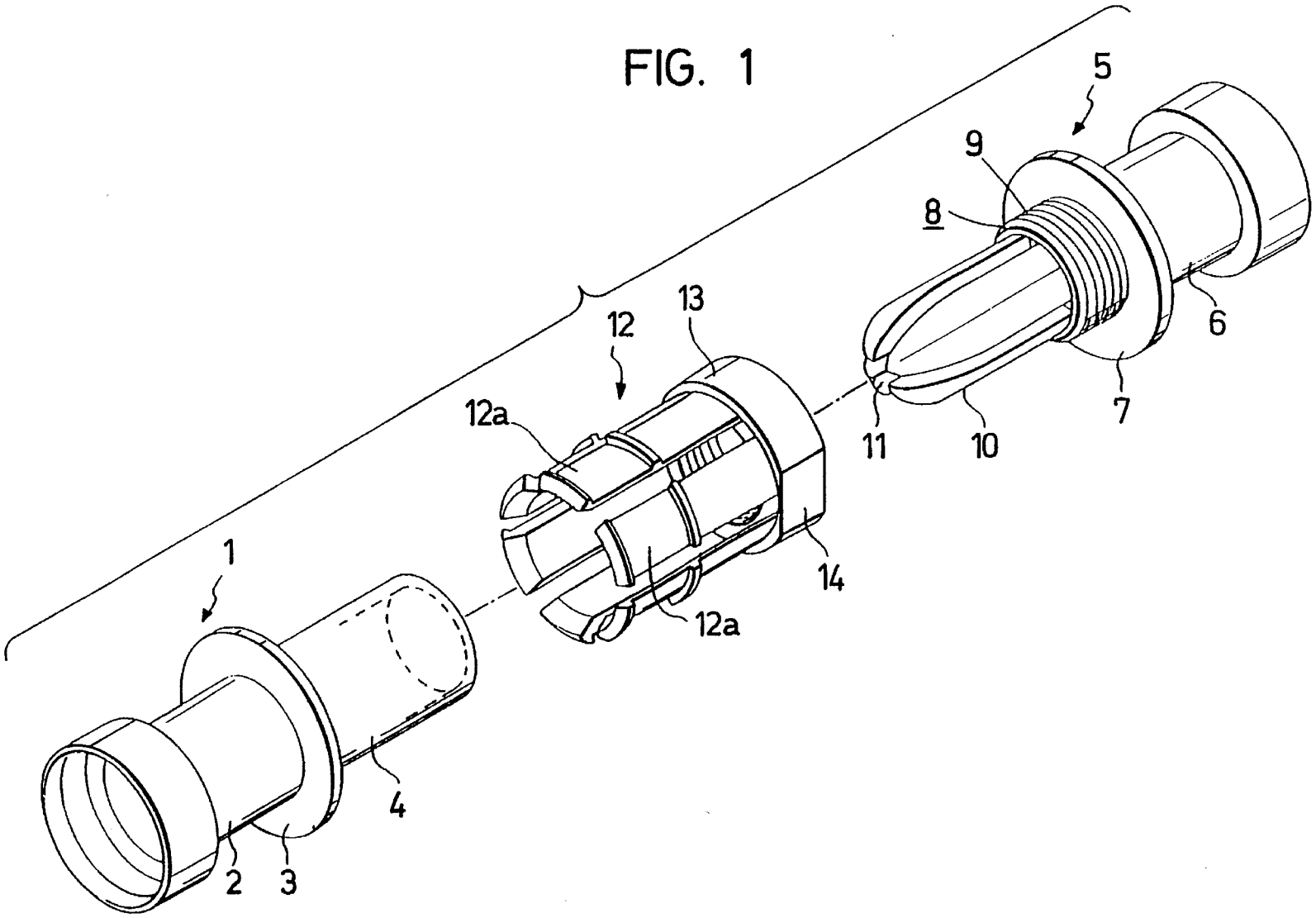
FIG. 1 is an exploded perspective view of a connector terminal.
Figure 2:
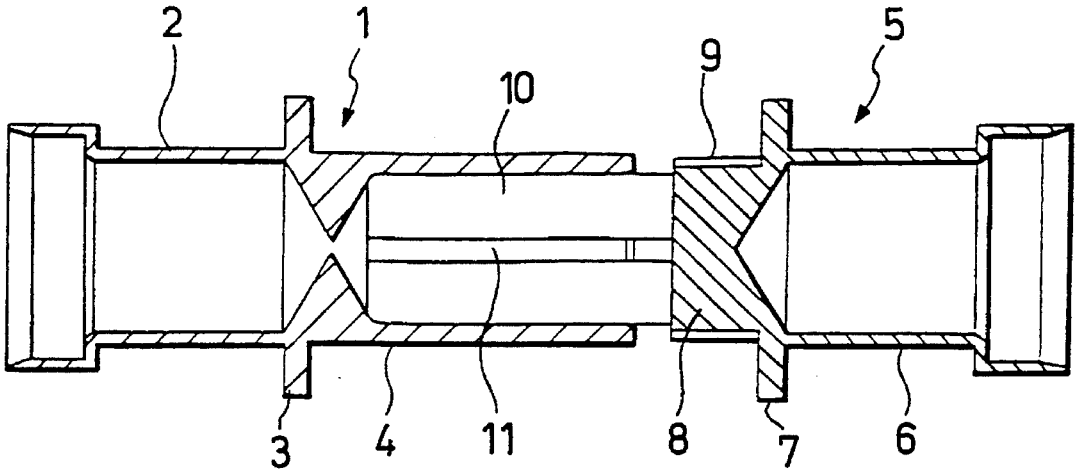
FIG. 2 is a cross-sectional view showing the condition of connection of two terminals.
Figure 3:
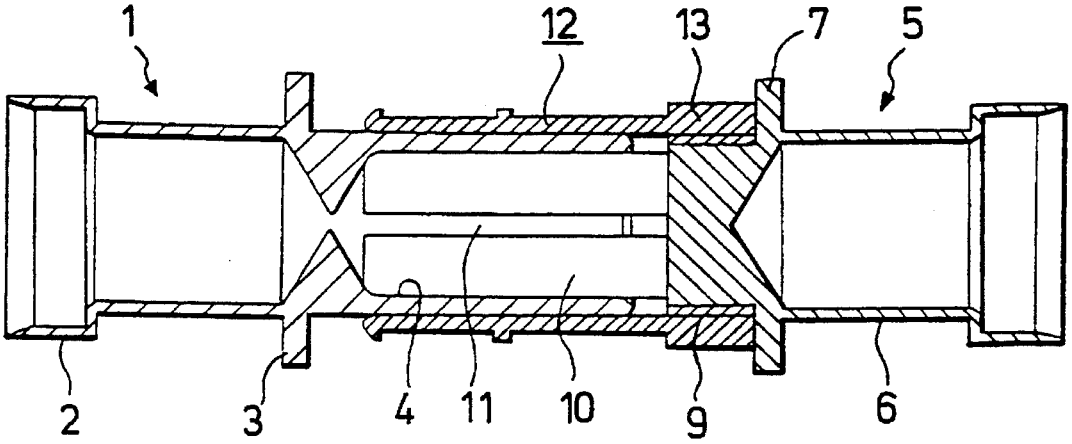
FIG. 3 is a cross-sectional view showing another condition of connection of the two terminals.

In FIG. 1, a first terminal 1 is shown at a left side and is incorporated into the car-side connector housing. The first terminal 1 is made of an electrically-conductive material and has at its rear end portion a two-step cylindrical wire holder portion 2 for receiving a wire (not shown). A flange 3 is formed in continuous relation to the wire holder portion 2, and a tubular portion 4 for receiving a second terminal 5 (later described) extends forwardly from the flange 3.

The second terminal 5, shown at a right side of FIG. 1, is incorporated into a charger-side connector housing (not shown). The second terminal 5 is also made of an electrically-conductive material and has a wire holder portion 6 at its rear end portion and a flange 7. A connection portion 8 of a cylindrical shape is formed at a front side of the flange 7, and threads 9 are formed in an outer peripheral surface of the connection portion 8. An inner terminal member 10 extends from the connection portion 8 in coaxial relation thereto. In this embodiment, the inner terminal member 10 is formed integrally with the connection portion 8. The inner terminal member 10 has a generally rounded shaft-shape as a whole, and the diameter of the inner terminal member 10 in its free condition is slightly larger than the diameter of the tubular portion 4 of the first terminal 1. However, expanding slots 11 are formed in the inner terminal member 10 to provide a cross-shaped cross-section. The slots extend from its front face to the connection terminal 8 along an axis thereof so that the inner terminal member can be deformed radially inwardly. Although not shown clearly in the drawings, the front end portion is slightly contracted radially to facilitate the insertion into the first terminal 1. With this construction, the inner terminal member 10 can be held in contact with the inner surface of the tubular portion 4 generally over the entire length thereof with a predetermined contact pressure.

An outer terminal member 12 is selectively attached to the second terminal 5. The outer terminal member 12 has a ring-shaped mounting base 13 and can be threaded on the connection portion 8 of the second terminal 5. In order to enable a tightening tool, such as a spanner, to be used, two symmetrically-disposed portions of the outer peripheral surface of the mounting base 13 are chamfered as at 14 (only one of which is shown in FIG. 1).

A plurality of spaced terminal pieces 12*a* are formed integrally on and extend from the peripheral edge of the mounting base 13 and are spaced at equal intervals in a circumferential direction. In a free condition, the arrangement of the spaced terminal pieces 12*a* is slightly contracted radially at its front end portion thereof in a free condition and has a diameter slightly smaller than the outer diameter of the cylindrical tubular portion 4 as a whole. The spaced terminal pieces, when connected to the cylindrical tubular portion 4 are expanded radially outwardly to be held in contact with the outer peripheral surface of the cylindrical tubular portion 4 generally over the entire length thereof with a predetermined contact pressure. The front edge portion of the arrangement of the spaced terminal pieces 12*a* flares into a bell mouth-shape to enable the connection operation to be effected smoothly.

When the connector terminal is specified to be used for the charger of a car in which the allowable value of the charging current is relatively low (about 60A), only the inner terminal member 10 is provided on the second terminal 5. In this specified design, when the two connector housings (not shown), connected respectively to the car and the charger, are fitted together, thereby fitting the first and second terminals 1 and 5 together, the inner terminal member 10 of the second terminal 5 is inserted into the tubular portion 4 of the first terminal 1, while gradually contracted. When the connection is completed, the inner terminal member 10 is held in contact with the inner surface of the tubular portion of the first terminal 1 with the predetermined contact pressure. Thus, a charging environment for a low charging current is achieved.

Figure 4:
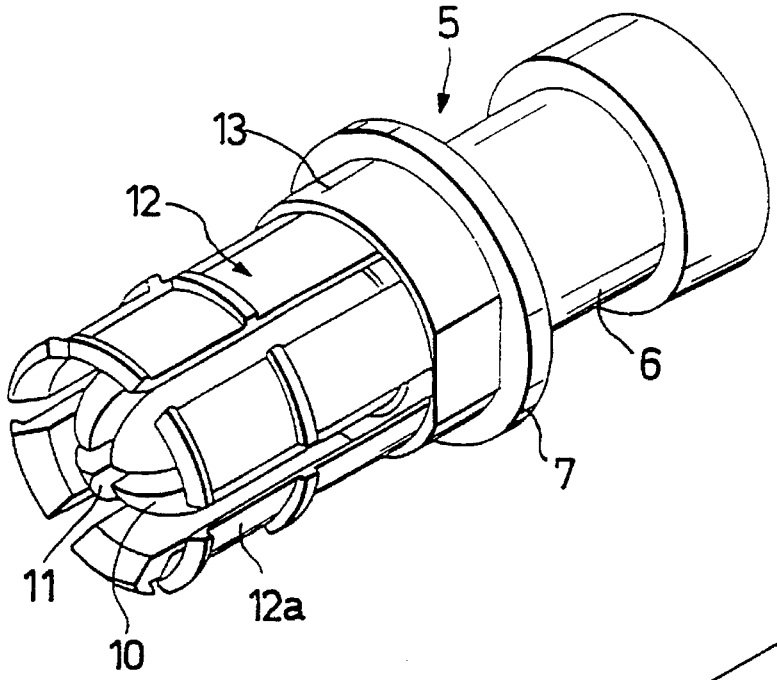
FIG. 4 is a perspective view showing a condition in which an outer terminal member is attached.

When the connector is specified to be used for the charger of a car in which the allowable value of the charging current is relatively high (about 90A), the outer terminal member 12 is further attached to the second terminal 5, in which case the mounting base 13 of the outer terminal member 12 is threaded on the connection portion 8 of the second terminal 5 (FIG. 4). In this specified design, the two connector housings are fitted together, thereby fitting the two terminals 1 and 5 together. As a result, the tubular portion 4 of the first terminal 1 is held in contact with the outer peripheral surface of the inner terminal member 10, as described above. At the same time, the tubular portion 4 of the first terminal 1 is inserted into the arrangement of the spaced terminal pieces 12 of the outer terminal member 12, while expanding it, and when the connection is completed, the tubular portion 4 of the first terminal 1 is held in contact with the outer terminal member 12 generally over the entire length thereof with the predetermined contact pressure. Namely, the tubular portion 4 of the first terminal 1 is inserted between the inner and outer terminal members 10 and 12 in contacting relation thereto. In this case, the area of contact between the two terminals is larger than that obtained with the above design, and therefore, a larger charging current can be accommodated.

As described above, in the first embodiment, by determining whether or not the outer terminal member 12 is attached to the second terminal 5, either of the large allowable current value and the small allowable current value can be selected. Namely, the combination of the first terminal and the second terminal having the inner terminal member can be used in both of the low current design and the high current design. In contrast, in the conventional construction, both of the first and second terminals must have specially-designed diameters. Therefore, in the first embodiment, there can be used more component parts than in the conventional construction, and therefore, the cost can be reduced; and at the same time, the management such as the management of component parts can be simplified. Moreover, in the first embodiment, the outer terminal member 12 can be threadedly attached, and therefore, the selected design can be easily obtained.

Figure 5:
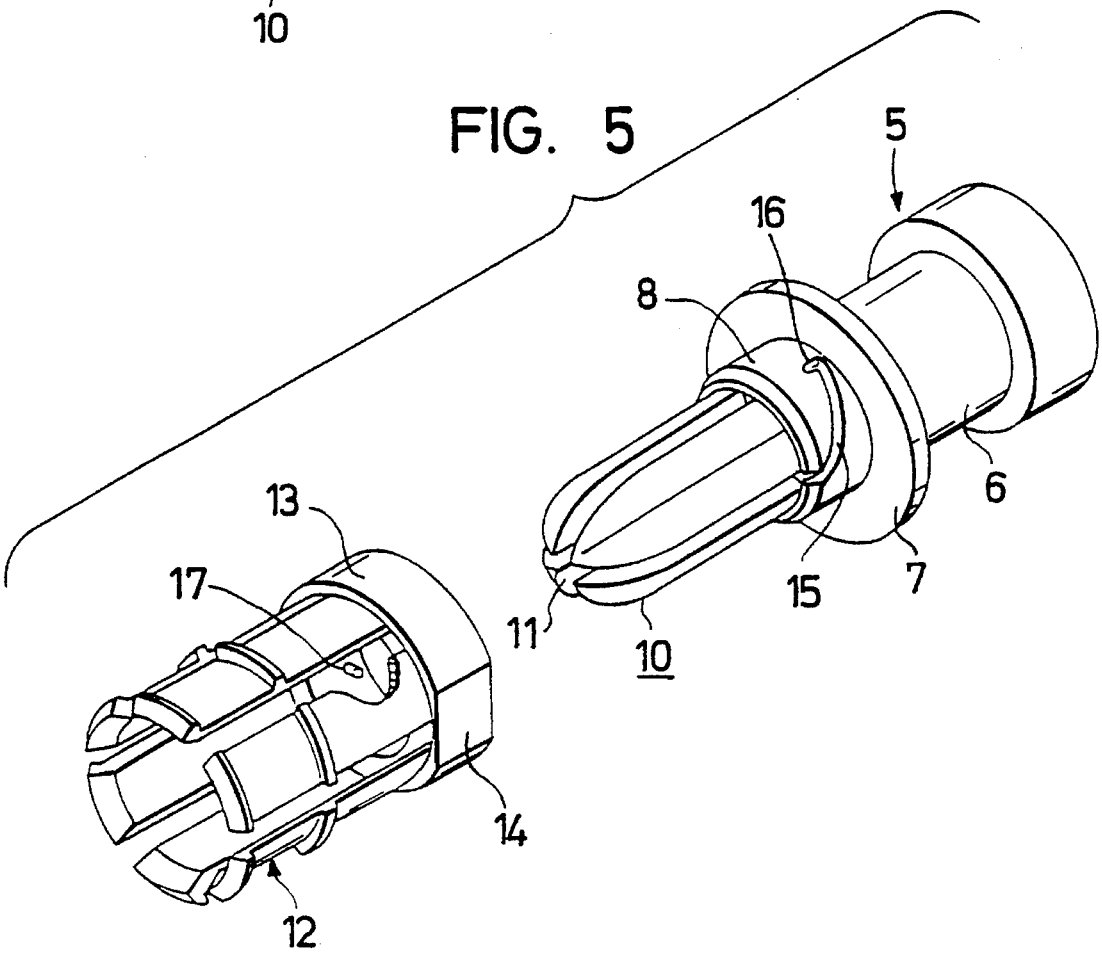
FIG. 5 is a perspective view showing a second embodiment.

The construction for rendering the outer terminal member 12 easily detachable is not limited to that of the first embodiment, but may be of the type of a second embodiment shown in FIG. 5. More specifically, in the second embodiment, a guide groove 15 is formed in a peripheral surface of a connection portion 8 of a second terminal 5, and a retaining portion 16 is provided at an end of the guide groove 15 in a bent manner in communication therewith. A projection 17 is formed on an inner peripheral surface of a mounting base 13 of an outer terminal member 12. By angularly moving the outer terminal member 12 relative to the second terminal 5, the projection 17 is guided by the guide groove 15, and is engaged with the retaining portion 16.

Thus, in the second embodiment, the attachment and detachment of the outer terminal member 12 can be effected with a smaller amount of angular movement of the outer terminal member 12 than in the first embodiment, and therefore, the operability is better. The remaining construction is the same as that of the first embodiment, and the same effect can be achieved.

With the constructions described above, although a single kind of first terminal is used, a plurality of allowable currents can be dealt with by selectively attaching the outer terminal member. With this arrangement, the number of kinds of connector terminals to be prepared can be reduced, and therefore the cost is reduced, and management can be simplified.

While the embodiments disclosed herein are preferred, it will be appreciated from this teaching that various alternatives, modifications, variations or improvements therein may be made by those skilled in the art that are within the scope of the invention, which is defined by the following claims.

For example, in either of the above embodiments, the outer terminal member 12 can be selectively attached; however, in contrast, the outer terminal member 12 may be beforehand provided integrally, in which case the inner terminal member 10 can be selectively attached. Alternatively, both of the inner and outer terminal members 10 and 12 may be detachable. Still further, the first terminal 1 may be connected to the charger while the second terminal 5 is connected to the car. The present invention is not limited to the type of connector for charging the car, but may be applied to connectors at large.

What is claimed is:

1. A connector terminal comprising a first terminal having a cylindrical tubular portion, and a second terminal that can be fitted in said tubular portion, wherein an outer terminal member and an inner terminal member for contacting respectively with outer and inner surfaces of said tubular portion are attached to said second terminal in coaxial relation, said outer terminal member being displaced radially from the axis of said cylindrical tubular portion and radially displaced and separated throughout from said inner terminal member when attached to said second terminal, and said outer terminal member being selectively removable from said second terminal without deformation of said outer terminal member or any portion of said second terminal.

2. A connector terminal comprising:

a first terminal having a cylindrical tubular portion;

a second terminal having an inner terminal member insertable in said cylindrical tubular portion; and an outer terminal member selectively engageable with an outer surface of said cylindrical tubular portion and said second terminal, said outer terminal member being displaced radially from the axis of said cylindrical tubular portion and radially displaced and separated throughout from said inner terminal member when attached to said second terminal, and said outer terminal member being selectively removable from said second terminal without deformation of said outer terminal member or any portion of said second terminal.

3. A connector terminal comprising:

a first terminal having a cylindrical tubular portion;

a second terminal having an inner terminal member insertable in said cylindrical tubular portion; and an outer terminal member selectively engageable with an outer surface of said cylindrical tubular portion and said second terminal, said outer terminal member being displaced radially from the axis of said cylindrical tubular portion and radially displaced and separated throughout from said inner terminal member when attached to said second terminal, and said outer terminal member being selectively removable from said second terminal without deformation of said outer terminal member or any portion of said second terminal and wherein said second terminal comprises a threaded connection portion, said outer terminal member comprising a mounting base that is threadedly engageable with said threaded connection portion.

4. A connector terminal according to claim 2, wherein said inner terminal member comprises a plurality of expanding slots, said slots facilitating engagement with said cylindrical tubular portion, wherein said terminal member contacts an inner surface of said tubular portion over substantially an entire length thereof with a predetermined contact pressure.

5. A connector terminal according to claim 2, wherein said outer terminal member comprises a mounting base and a plurality of spaced terminal pieces extending from a peripheral edge of said mounting base, said plurality of spaced terminal pieces being spaced at equal intervals in a circumferential direction.

6. A connector terminal according to claim 5, wherein said plurality of spaced terminal pieces are integral with said mounting base.

7. A connector terminal according to claim 5, wherein said mounting base is chamfered.

8. A connector terminal according to claim 5, wherein said spaced terminal pieces are contracted radially in a free condition and form a diameter that is smaller than said outer surface of said cylindrical tubular portion, said spaced terminal pieces expanding radially outwardly when said outer terminal member is engaged with said outer surface of said cylindrical tubular portion and said second terminal, wherein said spaced terminal pieces contact said outer surface of said cylindrical tubular portion over substantially an entire length thereof with a predetermined contact pressure.

9. A connector terminal according to claim 2, wherein said second terminal comprises a guide groove, said outer terminal member comprising a mounting base having a projection engageable with said guide groove.

10. A connector terminal according to claim 9, wherein said guide groove comprises a retaining portion engageable with said projection, said guide groove guiding said projection into engagement with said retaining portion.

* * * * *